US009336912B2

(12) United States Patent
Isensee

(10) Patent No.: US 9,336,912 B2
(45) Date of Patent: May 10, 2016

(54) PRODUCT CARTRIDGE FOR RADIONUCLIDE

(71) Applicant: NorthStar Medical Radioisotopes LLC, Madison, WI (US)

(72) Inventor: Glenn H. Isensee, Madison, WI (US)

(73) Assignee: NORTHSTAR MEDICAL RADIOISOTOPES LLC, Madison, WI (US)

( * ) Notice: Subject to any disclaimer, the term of this patent is extended or adjusted under 35 U.S.C. 154(b) by 0 days.

(21) Appl. No.: 14/528,866

(22) Filed: Oct. 30, 2014

(65) Prior Publication Data

US 2015/0123021 A1 May 7, 2015

Related U.S. Application Data

(60) Provisional application No. 61/897,501, filed on Oct. 30, 2013.

(51) Int. Cl.
*G21F 5/015* (2006.01)
*G21F 5/12* (2006.01)
*G21G 1/00* (2006.01)

(52) U.S. Cl.
CPC *G21F 5/015* (2013.01); *G21F 5/12* (2013.01); *G21G 1/0005* (2013.01)

(58) Field of Classification Search
USPC ..... 250/505.1, 506.1, 507.1, 515.1, 518.1, 250/519.1, 496.1
See application file for complete search history.

(56) References Cited

U.S. PATENT DOCUMENTS

2008/0200747 A1* 8/2008 Wagner et al. ..... 600/5
2012/0305429 A1* 12/2012 Mayfield ..... G21F 5/015 206/438

* cited by examiner

*Primary Examiner* — Nicole Ippolito
(74) *Attorney, Agent, or Firm* — Husch Blackwell LLP

(57) ABSTRACT

A product cartridge for a radionuclide including a product vial having a permeable cap and surrounded by a radiation shield and a filling cartridge having a separate radiation shield, the filling cartridge is supported adjacent the permeable cap by coupling the radiation shield of the filling cartridge to the radiation shield of the product vial, the filling cartridge is moveable within the radiation shield of the filling cartridge to engage and pierce the permeable cap during filling of the product vial, the filling cartridge includes an aperture on an end opposite the product vial that receives a radionuclide, a scavenger that removes heavy metals from the radionuclide and a filter that filters the biological contaminants, simultaneously venting the product vial as the radionuclide flows from the aperture through the filling cartridge and into the product vial.

15 Claims, 4 Drawing Sheets

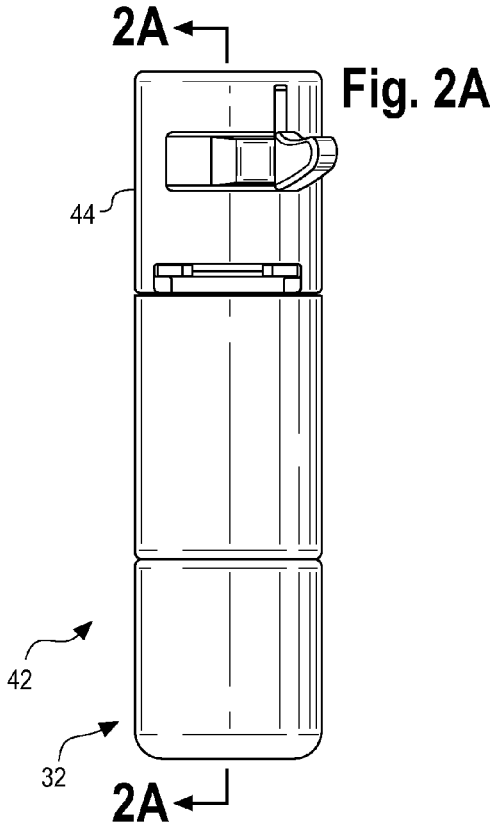
Fig. 2A
Fig. 2B
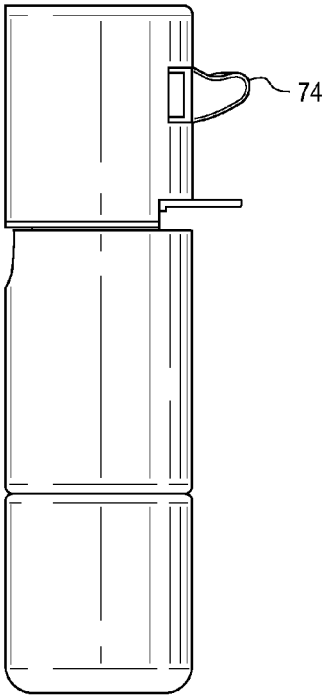
Fig. 2C
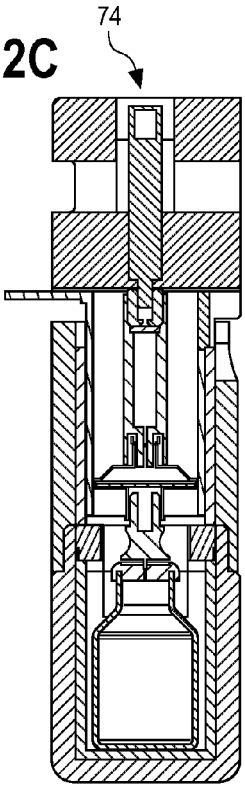

PRODUCT CARTRIDGE FOR RADIONUCLIDE

This Application is a continuation-in-part of U.S. Provisional Patent Application No. 61/897,501 filed on Oct. 30, 2013.

FIELD OF THE INVENTION

The field of the invention relates to nuclear medicine and more particularly, to methods of processing radioactive nuclides.

BACKGROUND OF THE INVENTION

The use of radioactive materials in nuclear medicine for therapeutic and diagnostic purposes is known. In the case of diagnostic medicine, radioactive material may be used to track blood flow for purposes of detecting obstructions or the like. In this case the radioactive material (e.g., a tracer) may be injected into a vein of the arm or leg of a person.

A scintillation camera may be used to collect images of the person following the injection. In this case, the gamma rays of the tracer interact with a detector of the camera to create images of the person.

A series of images are collected as the tracer perfuses through the person. Since the tracer diffuses through the blood of the person, the veins or arteries with greater blood flow produce a greater signature from the tracer.

Alternatively, radioactive material may be coupled at a molecular level with a biolocalization agent. In this case, the biolocalization agent may concentrate the radioactive material at some specific location (e.g., the site of a tumor).

Key to the use of radioactive materials in nuclear medicine is the creation of nuclear materials with a relatively short half life (e.g., 2-72 hours). In the case of the use of the radioactive materials with a biolocalization agent or for imaging, the short half life causes the radioactivity to decay rapidly in such as way as to reduce the exposure of the person to the radiation.

While the use of radioactive materials in nuclear medicine is extremely useful, the handling of such materials can be difficult. Materials with short half lives may require complex separation procedures to isolate the desired material from other materials. Once separated, the desired material must be easily accessible. Accordingly, a need exists for better methods of handling such materials.

BRIEF DESCRIPTION OF THE DRAWINGS

FIGS. 2A-C are front, side and cut-away views of a product cartridge assembly for use with the system of FIG. 1;

DETAILED DESCRIPTION OF AN ILLUSTRATED EMBODIMENT

Figure 1:
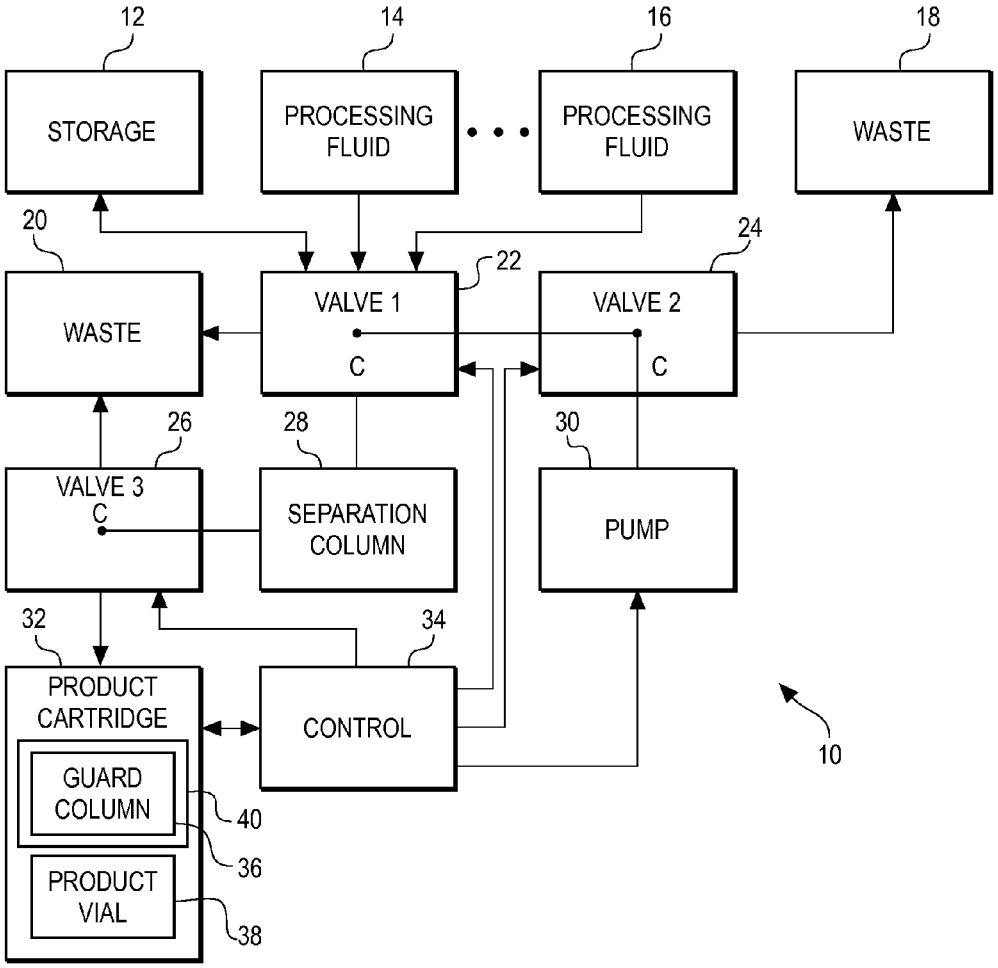
FIG. 1 is a block diagram of a system for generating radionuclides shown generally in accordance with an illustrated embodiment of the invention.

FIG. 1 is a block diagram of a separation system 10 used to separate radionuclides shown generally in accordance with an illustrated embodiment of the invention. The system 10 may be used to provide highly pure radioactive materials for use in diagnostic or therapeutic processes. The system 10 may be constructed as a portable device that is simple to use in radionuclide production facilities, nuclear pharmacies or in some other medical environment with various embodiments depending upon the isotope.

The system 10 may be used to separate a parent radionuclide from a daughter radionuclide using a forward COW process and where the daughter radionuclide is produced by the decay of the parent radionuclide. The system 10 may also be used to separate a daughter radionuclide from a parent radionuclide using a reverse COW process.

Included within the system 10 may be one or more separation columns 28, 36. The separation column 28 may be selected for purification of a wide range of radionuclides depending upon the diagnostic or therapeutic objectives. For example, the separation columns 26, 36 may be filled within a chromatographic material (e.g., ion-exchange resin, extraction chomotographic material, etc.) targeted for the specific radionuclide needed. In this regard, the system 10 may be used for the purification of yttrium-90, bismuth-212 and 213, or rhenium-188 for radiotherapy or technetium-99 m, thallium-201, fluorine-18 or indium-111 for diagnostic imaging.

In this regard, the system 10 may be provided with a parent radionuclide. After some period of time, some of the parent radionuclide will decay to produce a mixture of parent and daughter radionuclide. In this case, a controller 34 of the system 10 may activate one or more valves 22, 24, 26 and a pump 30 to transport the mixture of the parent and daughter radionuclide from a parent container 12 to a first separation column 28 that captures the daughter radionuclide. Once the mixture of parent and daughter radionuclide has passed through the separation column 28, the remaining parent may be transported back to the container 12.

The controller 34 may wash the first separation column 28 by activating valves 22, 24 to first withdraw a wash solution from a processing fluids container 14, 16 and then to discard the wash solution into a waste container 18, 20. The wash process may be repeated any of a number of times with the same or different types of wash solutions.

Once washed, the controller 34 may withdraw a stripping solution from one of the processing fluids containers 14, 16 and then pump the stripping solution through the first separation column 28, through valve 26 and into the product cartridge assembly 32. The stripping solution functions to release the daughter radionuclide from the separator column 28 and then transport the daughter radionuclide into the product cartridge assembly 32.

FIGS. 2A-C are front, side and cut-away views of the product cartridge assembly 32. The product cartridge assembly 32 serves the very important purpose of protecting the environment from spillage of radioactive materials and users of the system 10 from radiation.

The product cartridge assembly 32 includes the product cartridge 42 and the cartridge adapter 44. The cartridge adapter 44 may be semi-permanently attached to the housing of the system 10. In contrast the product cartridge 42 is removable and replaceable.

Figure 3A:
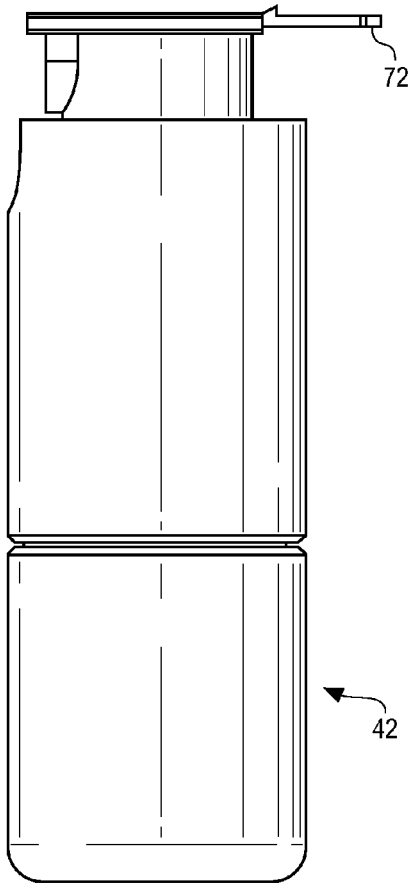
FIGS. 3A-C are side, top and cut-away views of the product cartridge of FIGS. 2A-C.
Figure 3C:
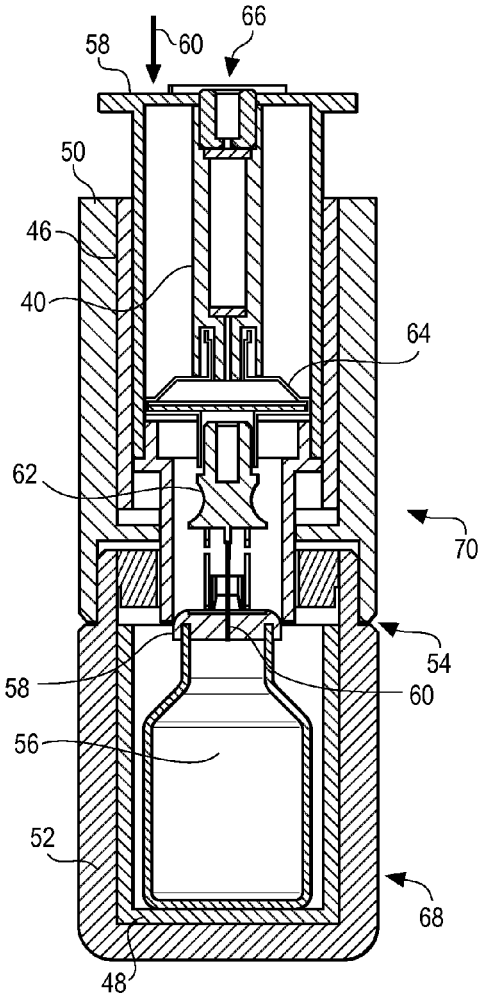
Figure 3B:
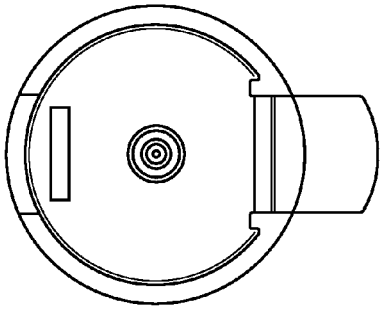

FIGS. 3A-C we side, top and cut-away views of the product cartridge 42. As shown in FIG. 3C, the product cartridge 42 includes a filling assembly 70 with an upper housing 46 and a product container 68 with a lower housing 48. The upper housing 46 and lower housing 48 may be constructed of polyethylene and operate as radiation shields for low energy particles.

Surrounding the upper and lower housings 46, 48 is a further upper radiation shield 50 and a lower radiation shield 52. The upper and lower radiation shields may be made of lead.

The product container 68 contains a product vial 56 sealed with a permeable cap 58 within the lower housing 48. In this case, the product vial 56 is filled via a projection (e.g., a syringe needle) 60 that penetrates the permeable cap 58.

The lower radiation shield 52 of the product container 68 may be provided with a reduced diameter coupler 54 that allows the product container 68 to be inserted or threaded into the filling assembly 70 as shown in FIG. 3A. The coupler 54 allows the product vial 56 to be safely filled with a radionuclide and also for the product container 68 to be subsequently separated from the filling assembly 70 where the separated product container 68 includes with the shield 42 and product vial 56 as a single unit.

Included within the upper housing 46 is a movable cartridge body 58. The needle 60 used for filling the product vial 56 is rigidly attached to the cartridge body 58.

Also included within the movable cartridge body 58, connected in series with the needle 60 is a secondary filter with vent 62, a particulate filter 64, the guard column 40 and a Lauer connector 66.

FIG. 3C shows the cartridge body 58 of the filling assembly 70 in an extended position with regard to the housing 46. In order to remove the product container 68 from the product cartridge 32, a user may grasp an external tab 72 and urge the movable cartridge body 58 upwards from the position shown in FIG. 3A until the needle 60 dislodges from the cap 58. The product container 68 may then be disconnected from the filling assembly 70.

In order to assemble a product cartridge 32, a user may select an appropriate filling assembly 70 and product container 68 and engage the shield 52 of the product container 68 to the shield 50 of the filling assembly 70 via the coupling 54. In order to complete the assembly, the user may apply a force 60 to the movable cartridge body 58 in order to move the cartridge body 58 downward sufficiently to cause the needle 60 to penetrate and extend through the cap 58.

Once the product cartridge 32 has been assembled, the cartridge 32 may be installed into the system 10. In this regard, the cartridge 32 is assembled to the cartridge adapter 44. Once installed beneath the cartridge adapter 44, a lever 74 (FIG. 2B) may be rotated from right to left. Rotation of the lever 74 causes a cam and cam follower attached to the lever 74 to move a male Lauer fitting downward and to advance into and engage the female portion of the connector 66.

Figure 4A:
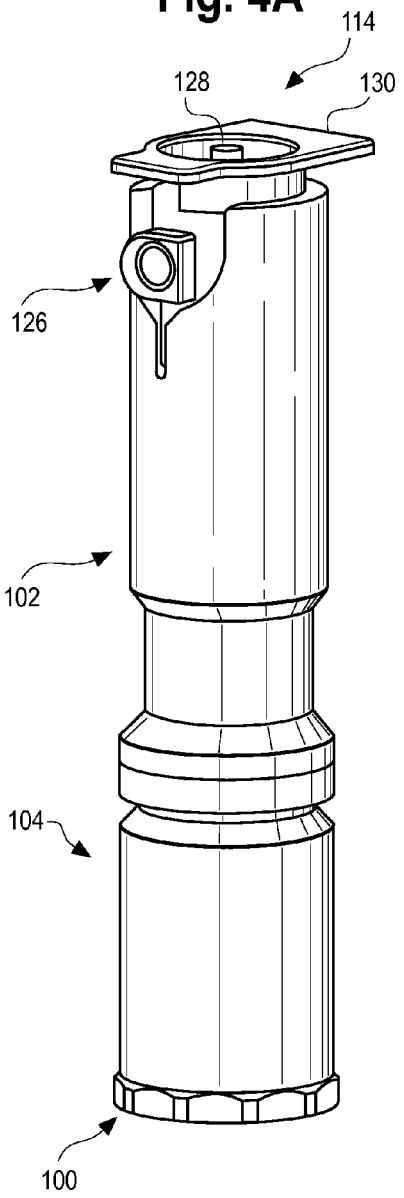
FIGS. 4A-B are a side and side cutaway view of a product cartridge assembly under an alternate embodiment.
Figure 4B:
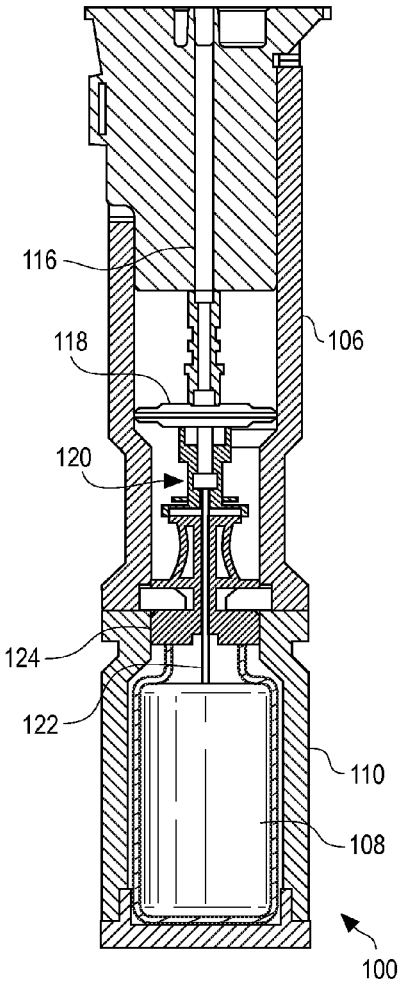

FIGS. 4A and 4B depict a product cartridge assembly 100 under another illustrated embodiment. As with previous embodiments, the assembly includes a filling assembly 102 and a product cartridge 104. However, in this embodiment, the product filing assembly includes a tungsten case 106 that protects users from radiation.

Similarly, the product cartridge includes a product vial 108 surrounded by a tungsten shield. The product cartridge may be attached to the filling assembly via a threaded connection 112.

The filling assembly includes a moveable connection assembly or filling cartridge 114 that moves relative to the outside shield 106. The connection assembly includes a filter assembly 116, a sanitary filter membrane 118 and a needle assembly 120. The filter assembly includes a guard resin that acts as a scavenger for heavy metals (e.g., parent isotopes). The needle assembly includes a hypodermic needle 122 that pierces a permeable cap 124 of the sterile product vial as the connection assembly is pressed downwards and simultaneously vents the container through an embodied sterility filter.

The filling assembly includes a radio frequency identification (RFID) tag 126. In this regard, the filling assembly is intended for a one-time use. Each time a product cartridge assembly is inserted into the separation system, the controller reads the RFID tag of the filling assembly and saves an identification number into memory as part of a tracking file for the finished product. The controller also search for any previous use of the filling assembly and rejects the process if the filling assembly has been previously used.

The connection assembly is connected to the separation system via a male Luer fitting 128. As the product cartridge assembly is inserted into a separator system, a tab may be grasped by a user and rotated to seat the Luer fitting into a female Luer fitting on the separation system.

In general, the product cartridge assembly includes a product vial having a permeable cap and surrounded by a radiation shield and a filling cartridge having a separate radiation shield, the filling cartridge is supported adjacent the permeable cap by coupling the radiation shield of the filling cartridge to the radiation shield of the product vial, the filling cartridge is moveable within the radiation shield of the filling cartridge to engage and pierce the permeable cap during filling of the product vial, the filling cartridge includes an aperture on an end opposite the product vial that receives a radionuclide, a scavenger that removes heavy metals from the radionuclide and a filter that filters the biological contaminants as the radionuclide flows from the aperture through the filling cartridge and into the product vial.

Alternatively, the product cartridge assembly includes an upper housing and a lower housing, the lower housing being coupled into the upper housing, the lower housing further including a shield that defines an outer surface of the lower housing, the shield substantially blocks radioactivity from the radionuclide, a product vial within the housing, the shield substantially surrounding the product vial and a cap on a top of the product vial, an upper surface of the cap being of a material that is easily pierced by a filling tubing, the upper housing further including, a shield that defines an outer surface of the upper housing, the shield substantially blocks radiation from the radionuclide, a filling cartridge having a closed top and bottom that slides within the upper housing from a retracted state and an active state, a receptacle disposed on the closed top with an aperture that extends from the receptacle through the closed top, a filling tube extending from the closed bottom, a proximal end of the filling tube extending through the closed bottom and a distal end of the filling tube residing in a spaced apart relationship with the upper surface of the cap in the retracted state and extending through the cap in the active state and a resin disposed within the sleeve between the upper receptacle and filling tube.

A specific embodiment of method and apparatus for generating radionuclides has been described for the purpose of illustrating the manner in which the invention is made and used. It should be understood that the implementation of other variations and modifications of the invention and its various aspects will be apparent to one skilled in the art, and that the invention is not limited by the specific embodiments described. Therefore, it is contemplated to cover the present invention and any and all modifications, variations, or equivalents that fall within the true spirit and scope of the basic underlying principles disclosed and claimed herein.

The invention claimed is:

1. A product cartridge for a radionuclide comprising:

a product vial having a permeable cap and surrounded by a radiation shield; and a filling cartridge having a separate radiation shield, the filling cartridge is supported adjacent the permeable cap by coupling the radiation shield of the filling cartridge to the radiation shield of the product vial, the filling cartridge is moveable within the radiation shield of the filling cartridge along an axis of insertion to engage and pierce the permeable cap during filling of the product vial, the filling cartridge includes an aperture on an end opposite the product vial that receives a radionuclide, a scavenger that removes heavy metals from the radionuclide and a filter that filters the biological contaminants as the radionuclide flows from the aperture through the filling cartridge and into the product vial wherein the product vial, the permeable cap, the radiation shields, the filling cartridge, the aperture, the scavenger and the filter are all mutually concentric with the product vial along the axis of insertion.

2. The product cartridge as in claim 1 further comprising a threaded connection between the two radiation shields.

3. The product cartridge as in claim 1 wherein the filling cartridge further comprises a syringe needle that pierces the permeable cap and simultaneously vents the container.

4. The product cartridge as in claim 1 further comprising a radio frequency identification (RFID) tag coupled to the radiation shield of the filling cartridge.

5. The product cartridge as in claim 1 wherein the aperture further comprising a male Luer fitting.

6. A product cartridge for a radionuclide comprising:

an upper housing and a lower housing, the lower housing coupled into the upper housing, the lower housing further comprising:

a shield that defines an outer surface of the lower housing, the shield substantially blocks radioactivity from the radionuclide;

a product vial within the housing, the shield substantially surrounding the product vial; and a cap on a top of the product vial, an upper surface of the cap being of a material that is easily pierced along an axis of insertion by a filling tubing;

the upper housing further comprising:

a shield that defines an outer surface of the upper housing, the shield substantially blocks radiation from the radionuclide;

a filling cartridge having a closed top and bottom that slides within the upper housing from a retracted state and an active state;

a receptacle disposed on the closed top with an aperture that extends from the receptacle through the closed top;

a filling tube extending from the closed bottom, a proximal end of the filling tube extending through the closed bottom and a distal end of the filling tube residing in a spaced apart relationship with the upper surface of the cap in the retracted state and extending through the cap in the active state; and a resin disposed within the sleeve between the upper receptacle and filling tube wherein the product vial, the cap, the radiation shield, the filling cartridge, the receptacle, the filing tube and resin are all mutually concentric with the product vial along the axis of insertion.

7. The structure as in claim 6 further comprising a filter in series with the resin.

8. The structure as in claim 6 wherein the coupling further comprises a set of male and female threads on the upper and lower housing that allows the lower housing to be threaded into the upper housing.

9. The structure as in claim 6 wherein the filling tube further comprises a syringe needle and vent aperture.

10. The structure as in claim 6 wherein the shield of the lower housing further comprises an inner layer of polyethylene and an outer layer of lead.

11. The structure as in claim 6 wherein the shield of the upper housing further comprises an inner layer of polyethylene and an outer layer of lead.

12. An apparatus comprising:

a product vial assembly for a radionuclide;

a radiation shield that surrounds the product vial;

a filling cartridge with a projection extending from a first end the filling cartridge; and a radiation shield that surrounds the filling cartridge along a longitudinal axis of the filling cartridge, the filling cartridge is moveable relative to the radiation shield along the longitudinal axis, wherein the radiation shield of the product vial supports the filling cartridge via the radiation shield of the filling cartridge and wherein a user urges the filling cartridge against a permeable cap of the product vial along the longitudinal axis to pierce the cap via the projection and to fill the product vial with a radionuclide wherein the radiation shields, the filling cartridge and the projection all mutually concentric with the product vial assembly along the longitudinal axis.

13. The apparatus as in claim 12 wherein the projection further comprises a needle and vent aperture.

14. The apparatus as in claim 12 further comprising a coupling on the second end of the filling cartridge that receives the radionuclide.

15. The apparatus as in claim 14 wherein the coupling further comprises a Luer fitting.

* * * * *